US007008360B1

(12) United States Patent
Smith

(10) Patent No.: US 7,008,360 B1
(45) Date of Patent: Mar. 7, 2006

(54) APPARATUS AND METHOD FOR IMPROVING BALANCE

(76) Inventor: Robert Samuel Smith, 1263 Emory St., San Jose, CA (US) 95126

( * ) Notice: Subject to any disclaimer, the term of this patent is extended or adjusted under 35 U.S.C. 154(b) by 0 days.

(21) Appl. No.: 10/388,842

(22) Filed: Mar. 15, 2003

(51) Int. Cl.
*A63B 22/16* (2006.01)

(52) U.S. Cl. ..... 482/146; 482/34; 482/44

(58) Field of Classification Search ..... 482/91, 482/907, 44–49, 140
See application file for complete search history.

(56) References Cited

U.S. PATENT DOCUMENTS 4,332,381 A * 6/1982 Lyons ..... 482/140
4,741,550 A * 5/1988 Dennis ..... 280/618
5,320,592 A * 6/1994 Olschansky et al. ..... 482/142
5,582,565 A * 12/1996 Soria ..... 482/141

* cited by examiner

*Primary Examiner*—Gregory L. Huson
*Assistant Examiner*—L. Amerson
(74) *Attorney, Agent, or Firm*—Robert Samuel Smith

(57) ABSTRACT

An apparatus and method for improving balance featuring a pedestal disk connected by a stem to a fulcrum disk which is supported on the floor. The user stands on the pedestal disk and performs exercises. Improvement of balance is measured by a timer which measures the period when the fulcrum is flush on the floor. An associated sighting device guides the user to maintain a fixed line of sight while performing exercises to improve eye-proprioceptive coordination. As the user improves his balance, he substitutes ever smaller fulcrum disks.

18 Claims, 3 Drawing Sheets

PROVIDE APPARATUS AS DECRIBED IN FIGS. 1 - 5

PLACE FULCRUM DISK ON SUPPORT SURFACE

STAND ON PEDESTAL DISK

PERFORM EXERCISE PROGRAM WHILE STANDING ON PEDESTAL DISK (OPTIONAL) MEASURE TIME OF BALANCE PERIOD AS A MEASUREMENT OF IMPROVEMENT (OPTIONAL) MAINTAIN A FIXED LINE OF SIGHT WHILE PERFORMING BALANCE EXERCISES USING STICK APPARATUS

FIG. 7

APPARATUS AND METHOD FOR IMPROVING BALANCE

FIELD OF THE INVENTION

This invention relates to apparatus and exercises for improving balance and particularly to a balance disk and sighting device that provides measured improvement of balance.

BACKGROUND OF THE INVENTION

Balance is a prime factor in most kinds of human performance. Maintaining balance is the function of a proprioceptor system which is a combination of muscle fiber and nerves in the muscle that senses contraction and sends signals to motor muscle units that respond to the neurological stimuli. The proprioceptors also cooperate with the eyes to control balance.

The proprioception system can be improved by balance exercise. It can also be degraded by injury and declines with age or lack of use.

In recent years, athletic trainers have acquired a growing interest in the value of incorporating into their training regimen, exercise routines directed specifically to the improvement of balance.

For the athlete, not only do these exercises improve performance, but they also help even the well conditioned athlete to avoid injury.

Devices that have appeared for this purpose include the "Baps" board which is a platform or disk supported on a fulcrum which, in some instances is a roller or (more commonly) a hemisphere wherein the flat part of the hemisphere is secured flush against the flat surface of a disk. The athlete stands on the side of the disk opposite the hemisphere, which is in contact with the floor and attempts to maintain his balance. He typically exercises with dumbbells while maintaining his balance. In another method of use, the athlete stands on the disk and rocks the disk from one side to another by shifting his weight.

The problem with performing with the present disk is that the balancing act is either all or nothing. By this is meant that the athlete experiences very little sensation when he goes off balance until the edge of the disk actually touches the floor. Balance is so difficult under these circumstances that exercise on the disk is performed by holding a dumbbell in one hand and a stick in the other hand with a bottom end of the stick in contact with the floor. The stick sends a message through the athlete's arms to the athlete as to when he is going off balance so that corrective action is required.

In performing an athletic action, the athlete does not have a stick. If he is shooting a basketball, hitting or throwing a baseball, etc., his "balance" message must come from his feet in contact with the ground in cooperation with messages he receives through his eyes. Consequently, use of a stick to sense off balance severely limits the effectiveness of the exercise.

Eye coordination with the proprioceptors also aids the balancing process. The role of the eyes in maintaining balance is demonstrated by having an athlete perform a balancing act with his eyes open and then with his eyes closed. Balancing with the eyes closed is more difficult than performing the same action (like standing on one foot) with the eyes open. In fact, improved proprioception that does not depend on eye coordination is experienced by athletes who practice their balancing routines with their eyes closed.

"Keeping your eyes focussed" is an admonition repeated over and over again in training sessions. For most all sports, "keeping your eyes focussed" means that the athlete must train his eyes on the ball regardless of any particular message of a myriad possible messages that his proprioceptors are sending to him in response to any one of the myriad of motions that the athlete may be forced to follow in order to complete a successful action.

For example, if a receiver is going up for a pass, regardless of how he is hit by a defender, he must keep focussed on catching the ball.

SUMMARY OF THE INVENTION

It is an object of this invention to provide an apparatus and method of use whereby the sense of balance originates with the foot in contact with the support surface rather than through an unrealistic aid such as stick in contact with the ground.

It is another object of this invention that the apparatus provide the means for the athlete to progress from a very early stage where difficulty to maintain balance for the average person is minimal to an advanced stage of balance. It is an object that the improvement from one stage to the next be expressed quantitatively thereby providing greater incentive to improve. This object is especially important to athletes recovering from debilitating injury, people that have been bedridden for a prolonged period, or elderly people who have a diminished sense of balance because of lack of use.

It is another object of the invention to include an apparatus which develops eye-proprioceptor coordination. In this mode of exercise, the athlete is trained to maintain eye focus while his proprioceptive system sends any one of a number of signals for maintaining balance.

This invention is directed toward a "pedestal" disk supported on one end of a vertical stem whose other end is engaged with a "fulcrum" disk. The pedestal disk is typically 16 inches diameter. The fulcrum disk is anyone of a number of diameters typically ranging from seven inches down to one-half inch. The user balances himself by standing on the pedestal disk and performs exercises with free weights. When the user begins his balance training program he selects a "large" fulcrum disk. As he masters a series of exercises, he exchanges the fulcrum disk for an ever smaller fulcrum disk. With each reduction in size of the fulcrum disk, maintaining balance becomes more difficult.

One important advantage of the invention, compared to the standard practice of balancing on a fulcrum that is a hemisphere or half cylinder, is that the athlete "feels" the sensation of stability when the fulcrum disk is flat on the floor. The "feeling of stability" sensation is very pronounced when the fulcrum disk is large. As the athlete progresses to smaller disks, the ability of his proprioceptors to detect the stable condition improves and is a measure of his proprioceptor conditioning.

Another variable for varying the difficulty of maintaining balance is selection of the stem connecting the pedestal disk to the fulcrum disk. Typically, each exercise disk set of this invention has three changeable stems—two, four and six inches. Beginners (and particularly elderly beginners or athletes undergoing a rehabilitation program) typically use the two inch stem and seven inch fulcrum disk. Very advanced athletes use a six inch stem and one inch fulcrum disk.

The theory of the exercise program of this invention to develop eye-proprioceptive coordination is based on the fact that balancing in many instances is the act of maintaining vertical alignment of the center of gravity of the body with the force applied by the body support. For example, when an athlete stands on one foot his center of gravity is on a vertical line that passes right through the foot. If one part of his body moves to one location, (e.g., a punter kicking a football) then another part of his body must shift in order to compensate for this motion and maintain balance. Highly developed eye-proprioceptive coordination maintains eye focus regardless of the proprioceptive induced compensation introduced to maintain balance.

In order to involve development of eye-proprioceptor coordination, an eye alignment device is applied which is a feature of this invention. This device is a guide that alerts the athlete that he has "lost eye focus" when a position of his body has shifted in response to a proprioceptive signal. The device comprises three vertical sticks. A triangle is defined by one stick at each apex of a triangle. Two of the sticks are spaced close to one another so that the side of the triangle defined by these two sticks is relatively short. The athlete places his balance disk at a location where he can view the distant stick between the two close sticks. The athlete performs the exercise on the disk and attempts to maintain a field of view where the distant stick is always between the two close sticks.

For example, if while standing on the disk and viewing the distant stick between the close sticks, he then raises one leg to one side, then his torso must shift in order to maintain balance while his eyes maintain the line of sight to the distant stick between the close sticks.

The foregoing summary has highlighted features, aspects and advantages of the present invention. The invention is further explained by the following description of what I presently believe to be the best mode for carrying out the invention illustrated by drawings to which are appended claims which define the scope of the invention.

BRIEF DESCRIPTION OF THE DRAWINGS

FIG. 7 is a flow chart listing steps in the method to improve balance.

DESCRIPTION OF A BEST MODE

Figure 1:
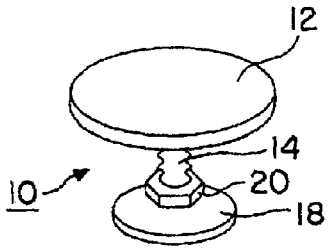
FIG. 1 shows a perspective assembly view of the invention.
Figure 2:
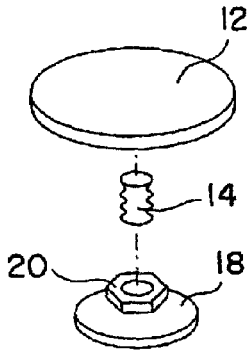
FIG. 2 is an exploded view of FIG. 1.

Turning now to a discussion of the drawings, FIG. 1 is a perspective assembly view of the balance disk 10 of this invention. FIG. 2 is an exploded view of FIG. 1.

There is shown a "pedestal" disk 12 having a diameter that is preferably in the range of thirteen to twenty inches. In the center on one side of the pedestal disk 12 is secured a threaded nut 16 (not shown in FIGS. 1 and 2 whose axis is coincident with the centerline of the pedestal disk 12.

One end of a threaded stem 14 is screwed into the nut.

A fulcrum disk is shown having a second threaded nut 20 mounted concentrically in the center of the fulcrum disk 20.

The other end of the threaded stem 14 is screwed into the second threaded nut 20.

The stem 14 is preferably one inch dia. threaded rod. Each disk set typically includes a pedestal disk 12, a number of fulcrum disks 14 (typically about six) ranging in dia from about seven inches down to 0.075 in.) and three stems, (2 inches, 4 inches, 6 inches).

In use, the assembly is placed with the selected fulcrum disk on the floor so that the user can stand on the pedestal disk.

The athlete performs any group of numerous exercises that can include:

1 Jumping up and down with both feet on the disk.
2 Jumping up and down with one feet on the disk.
3 Calisthenics such as bending over and touching ones toes.
4 Curls, presses, rows shrugs with free weights.
5 Repeatedly tipping the disk causing one length of edge of the disk to contact the floor and then an opposite length to contact the floor.

According to the method of the invention, the fulcrum disk selected by the athlete is sufficiently large that he initially has some success in maintaining balance as he performs the exercise.

After a sufficient number of exercise sessions, as a result of which the athlete's ability to balance on the disk improves, the athlete exchanges his "fulcrum" disk for a smaller "fulcrum" disk. As his balancing ability continues to improve, he selects ever smaller fulcrum disks.

An important feature in performing these balancing exercises is that the athlete can "feel" when the disk is out of balance. This enables him to further quantize his progress by timing with a stop watch.

For example, he can stand on one foot and time the length of time that he can maintain balance.

The average elderly person can balance himself on one leg for only a few (ten) seconds. If he closes his eyes, this time period is much shorter. According to one method of practicing, a time objective, e.g., 30 sec. is set to balance on the disk 12 with the largest fulcrum disk 18. When he has improved to where he can maintain this balance with the large fulcrum disk 18, then he goes to progressively smaller fulcrum disks.

The ability to SENSE WHEN THE DISK IS IN BALANCE and therefore accurately measure the time that balance is maintained by virtue of the flat balancing surface of the fulcrum disk, is an important feature of the invention.

Figure 3:
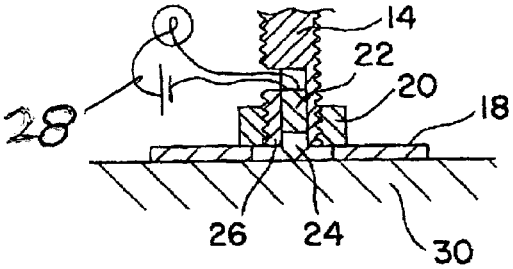
FIG. 3 is a sectional view showing a switch in the end of the stem in contact with the support surface flush with the fulcrum disk.

FIG. 3 illustrates an additional variation being a switch positioned in the bottom of the fulcrum disk that closes when the fulcrum disk is flat on the floor. A signal light turns on when the switch closes thereby providing an accurate means for timing the period that the disk is in balance.

FIG. 3 is a sectional view showing the stem 14 (cutaway) screwed into nut 20 secured to the fulcrum disk 18. A (normally off) momentary push button switch 22 is secured in a cavity in the end of the stem 14 such that the push button 24 protrudes through a hole 26 in the center of the fulcrum disk 18. The switch 22 is serially connected to a battery 28 and light 30 which turns on when the fulcrum disk 14 is flat on the floor 30. The light 30 is visible to the athlete or a coach as balance is maintained by the athlete on the pedestal disk 12.

The value of being able to time periods of balance with a stop watch is a direct result of the flat contact surface of the fulcrum disk. Use of the stop watch to measure improvement is a powerful motivator. Any comparable result simply cannot be experienced with the balancing disks of the present art.

After a number of sessions, as the athlete's balancing skill improves, he replaces the fulcrum disk 18 with another smaller fulcrum disk. The largest practical fulcrum disk is about seven inches diameter. The smallest practical fulcrum disk is about 0.75 inches diameter.

Figure 4:
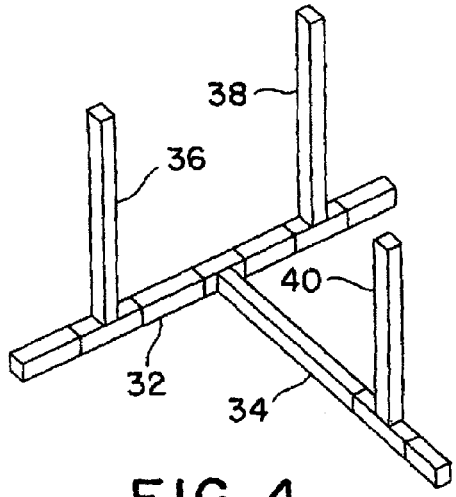
FIG. 4 shows a sighting device to maintain line of sight while balancing on the disk.

FIG. 4 shows in perspective a device of this invention used in conjunction with the disk of FIG. 1, 2 to develop eye-proprioceptive coordination.

There is shown a stand comprising a cross piece 32 with an end of a center piece 34 perpendicularly joined to the center of the cross piece 32.

There is also shown three other sticks. 36,38,40 supported vertically on the stand. One stick 36 has a lower end movably joined toward one end of the cross piece and another stick 38 has a lower end movably joined toward an opposite end of the cross piece 32. A third stick 40 has a lower end movably joined to the center piece 34.

Figure 5:
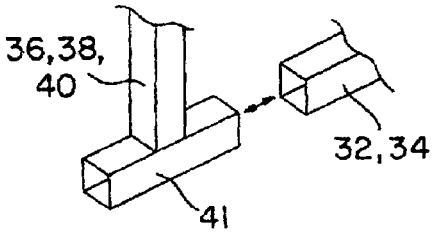
FIG. 5 shows details for attaching the sighting sticks to the horizontal cross members.

FIG. 5 shows details of the construction according to which the three sticks 36, 28, 40 are mounted on the respective branches of the stand. There are shown the lower ends of the sticks with short stubs 41 that telesccope onto the telescope onto the members of the stand. The sticks 36, 38, 40 are slideably positionable on the respective members, 32 and 34.

Figure 6:
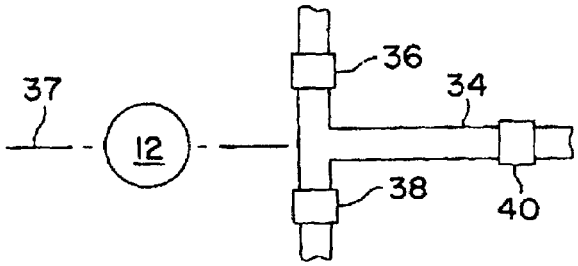
FIG. 6 is a top view for sighting the third stick between two sticks while balancing on the pedestal disk.

FIG. 6 is a top view showing the relative positions of the sticks, the disk and the athlete when practicing the method of exercise to develop eye-proprioceptor coordination.

The disk 12 is placed on a line 37 with the center piece 34. The two sticks 36. 38 on the cross piece 32 are closer to the disk 12 than the center stick 40 on the center piece 34. When the athlete stands on the disk 12, his eyes are fixed on the center stick between the two sticks on the cross piece. The athlete performs exercises such as squats, jumps dumbbell exercises while continuing to shift his head so that the distal center stick 40 continues to lie on the line of sight between the nearest sticks 36. 38. The combined action of exercise, maintaining balance, and maintaining visual alignment of the sticks requires a degree of eye, proprioceptor coordination that improves with practice and can be made more difficult by moving the sticks 36, 38 on the cross member 32 closer together and substituting ever smaller fulcrum disks 18.

FIG. 7 is a flow chart listing steps in the method for performing exercises to improve balance using the apparatus of this invention.

In step 1 an apparatus is provided comprising a stem having one end connected to a pedestal disk and another end connected to a fulcrum disk as described in FIGS. 1–5.

In step 2, a side of said fulcrum opposite said stem is placed on a support surface;

In step 3 the user stands (balances) on a side of said pedestal disk opposite said stem;

In step 4, the user performs a program of exercises.

In step 5, exchanging the fulcrum disk for an ever smaller fulcrum disk as the athlete's balance improves.

An optional step in step 4 is for the user to measure the period of time that he maintains balance on the disk as a means of quantitatively measuring improvement.

Another optional step in step 4 is to maintain a fixed line of sight using the apparatus of FIGS. 4 and 5.

Figure 8:
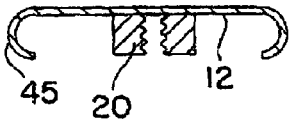
FIG. 8 is a sectional view of the pedestal disk showing a rolled edge to improve strength.

FIG. 8 is a sectional view of the disk 12 showing a preferred construction of the disk 12. The disk 12 is steel and has a rolled edge 45 to provide. sufficient strength to support an athlete jumping on the disk or supporting an athlete weighing over 300 lbs.

Figure 9:
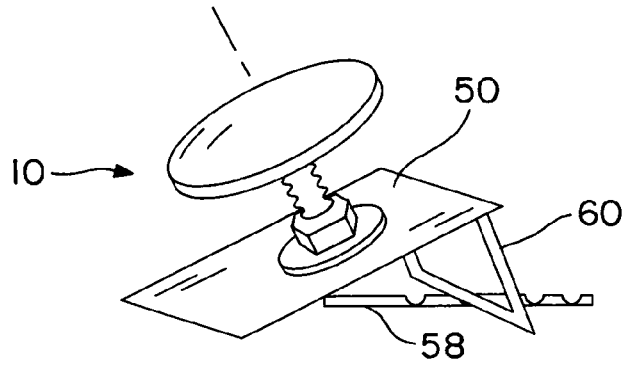
FIG. 9 shows the balance disk supported at an inclination on a stand

FIG. 9 shows a variation of the apparatus and method of the invention that is particularly advantageous for athletes training to develop the ability to dodge, make cuts (switch directions}, and generally perform manuvers that require balance and ankle strength.

There is shown the balance disk 10 of FIG. 1 positioned on top of an incline platform 50.

The angle of inclination of the incline platform is adjustable.

Figure 10:
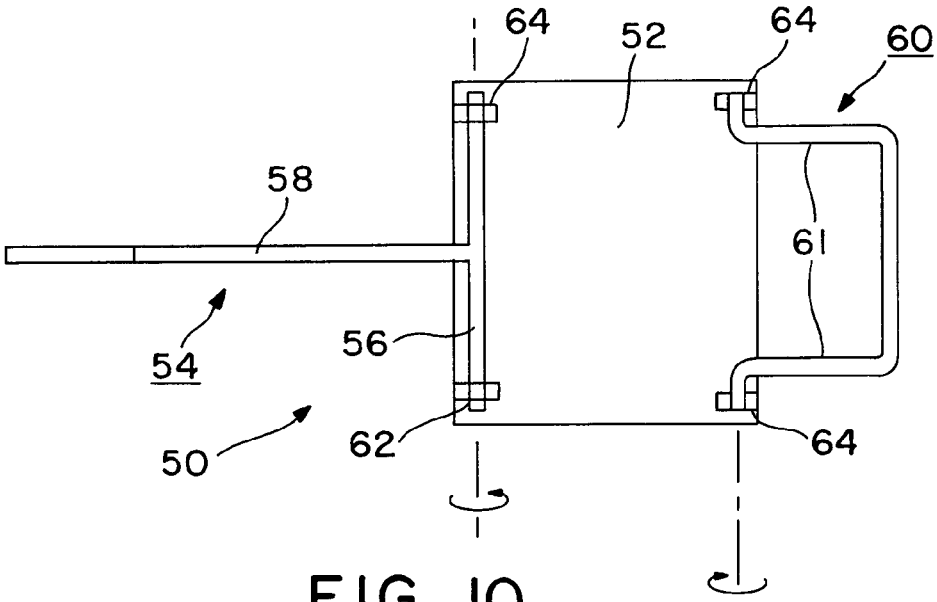
FIG. 10 shows details of the stand.

FIG. 10 shows the underside of the incline platform 50 showing details to best advantage. There is shown a plate 52 and a Tee bar 54. The Tee bar 54 has a cross bar 56 and a center bar 58. The cross bar 56 has notches 57 as shown in the side view of FIG. 11.

There is also shown a U-shaped brace 60 having a joining bar with ends perpendicularly joined to the ends of two legs 61 respectively.

The ends 62 of the cross bar 56 are hingeably mounted by straps 64 on one end of the plate 52. The ends of the legs 61 of brace 60 are hingably mounted on the opposite end of the plate 52 by the U-straps 64 shown in FIG. 10.

Figure 11:
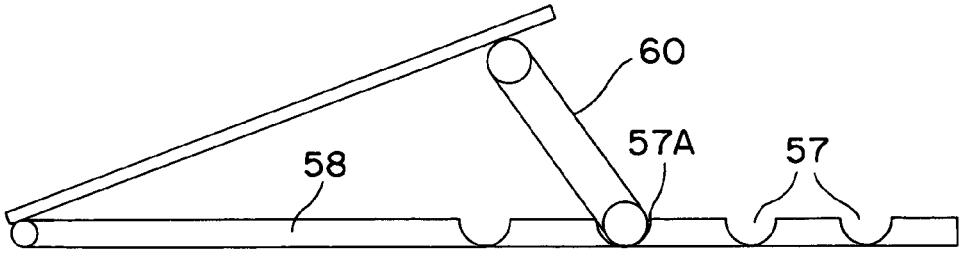
FIG. 11 is a side view of the stand.

FIG. 11 is a side view of the inclined plane showing the notches 57 in the center bar 58. The center bar 58 is preferably a length of steel angle. FIG. 11 also shows the center section of brace 60 engaged in a selected notch 57A of notches 57.

An apparatus and method of exercise have been describd to improve eye-proprioceptor coordination. Effectiveness of the exercise resides in clearly sensing loss or gain of stability which is not experienced with other devices intended for the same purpose. Variations and modifications may be contemplated after studying the drawings and reading the specification which are within the scope of the invention.

I therefore wish to define the scope of my invention by the appended claims.

What is claimed is:

1. A device for practicing balancing exercises which comprises:

a stem;

a pedestal disk;

a plurality of fulcrum disks, each of said fulcrum disks having a diameter in a range beginning with a largest disk having a largest diameter down to a smallest fulcrum disk having a smallest diameter;

means to detachably attach one end of said stem perpendicularly to a center of said pedestal disk;

means to detachably attach an opposite end of said stem perpendicularly to a center of any one of said fulcrum disks whereby a user is enabled to place said fulcrum disk on a support surface with one end of said stem attached to said fulcrum disk and an opposite end of said stem attached to said pedestal disk and stand on said pedestal disk while performing exercises.

2. The device of claim 1 wherein said pedestal disk has a diameter in a range from twelve to twenty inches and said fulcrum disks have diameters in a range from seven to three quarter inches.

3. The device of claim 1 wherein said means to detachably attach one end of said stem perpendicularly to a center of said pedestal disk and said fulcrum disk comprises:

said stem being a threaded rod;

a nut secured to a center of said pedestal disk arranged to screw onto said one end of said threaded rod;

another nut secured to a center of said fulcrum disk arranged to screw onto said opposite end of said threaded rod.

4. The device of claim 3 which comprises:

a momentary switch;

means for mounting said switch on an end of said stem secured to said fulcrum disk;

said switch operably arranged in combination with said fulcrum disk, end of said stem and said nut securing said stem to said fulcrum disk to close when said fulcrum disk is flush on said support surface;

a lamp and power supply for said lamp;

said switch serially connected to said lamp and power supply arranged to light when said switch is closed and said fulcrum disk is flush on said support surface.

5. The device of claim 3 which comprises a timer means foe measuring a balance period whereby a user attempting to maintain balance while standing on said pedestal disk is enabled to measure said timing period when he first feels that said fulcrum disk is flush against a support surface and ends when said user feels that said fulcrum disk ceases to be flush with said support surface.

6. The device of claim 3 which comprises:

a momentary normally off switch;

means for mounting said switch on an end of said stem secured to said fulcrum disk;

said switch operably arranged in combination with said fulcrum disk, end of said stem and said nut securing said stem to said fulcrum disk to close when said fulcrum disk is flush on said support surface;

a timer;

said switch serially connected to said timer arranged to time a period when said switch is closed and said fulcrum disk is flush on said support surface.

7. The device of claim 1 which comprises:

three sticks;

a stand arranged for supporting said three sticks vertically on a support surface;

an end of each of two of said sticks positioned on a horizontal connecting line and an end of a third one of said three sticks is positioned on a horizontal center line perpendicularly bisecting said connecting line;

said fulcrum disk attached by said stem to said pedestal disk positioned on said center line enabling a user to practice standing on said pedestal disk and perform exercises while maintaining a line of sight in which said third stick is viewed between said two sticks.

8. A method for improving balancing skills which includes the steps:

A) provide an apparatus which comprises:

i) a stem;

ii) a pedestal disk;

iii) a plurality of fulcrum disks having diameters in a range beginning with a largest fulcrum disk having a largest diameter down to a smallest fulcrum disk having a smallest diameter;

iv) means to detachably attach one end of said stem perpendicularly to a center of said pedestal disk;

v) means to detachably attach an opposite end of said stem perpendicularly to a center of any one of said fulcrum disks whereby a user is enabled to place said fulcrum disk on a support surface with one end of said stem attached to said fulcrum disk and an opposite end of said stem attached to said pedestal disk and maintain balance while standing on said pedestal disk while performing exercises;

B) place a side of said fulcrum opposite said stem on a support surface;

C) stand on a side of said pedestal disk opposite said stem;

D) perform a program of exercises;

E) exchanging the fulcrum disk for an ever smaller fulcrum disk as balancing skill improves.

9. The method of claim 8 wherein said means for detachably attaching one end of said stem to said pedestal disk comprises:

said stem being a threaded rod;

a threaded nut secured concentrically to said pedestal disk selected for engaging one end of said stem permitting that said one end be screwable into said nut.

10. The method of claim 8 wherein said means for detachably attaching one end of said stem to said fulcrum disk comprises:

said stem being a threaded rod;

a threaded nut secured concentrically to said pedestal disk selected for engaging one end of said stem permitting that said one end be screwable into said nut.

11. The method of claim 8 wherein said program of exercises comprises at least one of:

standing with both feet on said pedestal platform;

standing with one foot on said pedestal platform;

standing on both feet on said pedestal platform and performing squats;

standing on one foot on said pedestal platform and performing one-legged squats;

standing on both feet on said pedestal platform and holding free weights and performing upper body exercises with said free weights;

standing on one foot on said pedestal platform and holding free weights and performing upper body exercises with said free weights.

12. The method of claim 8 wherein said apparatus further comprises:

a switch mounted in an end of said stem adjacent said fulcrum disk and arranged to close when said fulcrum disk is flush against a support surface;

a timer connected in series with said timer; and said step D further comprises measuring a period beginning when said fulcrum disk is flush on said support surface and ends when said fulcrum disk is no longer flush with said support surface.

13. The method of claim 8 wherein said apparatus further comprises:

a switch mounted in an end of said stem adjacent said fulcrum disk and arranged to close when said fulcrum disk is flush against a support surface;

a lamp and power supply connected in series with said timer; and said step D further comprises said lamp lighting when a period beginning when said fulcrum disk is flush on said support surface and ends when said fulcrum disk is no longer flush with said support surface.

14. The method of claim 8 wherein said apparatus further comprises:

three sticks;

a stand arranged for supporting said three sticks vertically on a support surface;

an end of each of two of said sticks positioned on a horizontal connecting line and an end of a third one of said three sticks is positioned on a horizontal center line perpendicularly bisecting said connecting line;

said fulcrum disk attached by said stem to said pedestal disk positioned on said center line enabling a user to practice standing on said pedestal disk and perform exercises while maintaining a line of sight in which said third stick is between said two sticks; and said steps C and D include said user standing on said pedestal disk maintaining a line of sight in which said user views said third stick between said two sticks.

15. The device of claim 3 wherein said pedestal disk is a steel disk with a rolled rim.

16. A device for practicing balancing exercises which comprises:

a stem;

a pedestal disk;

a plurality of fulcrum disks, each of said fulcrum disks having a diameter in a range beginning with a largest disk having a largest diameter down to a smallest fulcrum disk having a smallest diameter;

means to detachably attach one end of said stem perpendicularly to a center of said pedestal disk;

means to detachably attach an opposite end of said stem perpendicularly to a center of any one of said fulcrum disks;

an incline plate having a top surface arranged for supporting said fulcrum disk flush on said top surface and an onderside surface;

means for supporting said incline plate at a selected inclination on a horizontal support surface with said fulcrum disk positioned on said top surface providing that a user is enabled to stand on said pedestal disk and perform exercises.

17. The device of claim 16 wherein said means for supporting comprises:

a Tee bar being a center bar having one end perpenciularly joined to a center of a cross bar;

said cross bar having two ends joined to said underside arranged to permit said cross bar to rotate about its centerline parallel and adjacent to an edge of said underside;

said center bar having a row of notches;

a brace being a joiniung bar with one end perpencicularly joined to one end of a leg and another end joined perpendicularly to one end of another leg providng that said brace has a U shape;

each leg having a free end hingably joined near another edge parallel to said one edge of an underside side of said incline plate;

said brace operably arranged in combination with said Tee bar to permit engagement of said joining bar with a selected one of said notches.

18. A device for supporting a fulcrum disk at a selected inclination which comprises:

an incline plate having one side intended for supporting said fulcrum disk and an underside;

a Tee bar being a center bar having one end perpenciularly joined to a center of a cross bar;

a pair of straps, one said strap straddling one end of said cross bar and another said strap straddling an opposite end of said cross bar;

said pair of straps secured to said underside of said incline plate and rotatably securing said cross bar to rotate about its centerline parallel and adjacent to an edge of said incline plate;

said center bar having a row of notches;

a brace being a joiniung bar with one end perpencicularly joined to one end of a leg and another end joined perpendicularly to one end of another leg providng that said brace has a U shape;

each leg having a free end hingably joined near another edge parallel to said one edge of an underside side of said incline plate;

said brace operably arranged in combination with said Tee bar to permit engagement of said joining bar with a selected one of said notches.

* * * * *